United States Patent [19]

Sadeh

[11] Patent Number: 4,467,735

[45] Date of Patent: Aug. 28, 1984

[54] SEWING MACHINE INCLUDING WORKPIECE CLAMPING DEVICE

[75] Inventor: Yaacov Sadeh, Beersheva, Israel

[73] Assignee: Beta Engineering & Development Ltd., Beersheva, Israel

[21] Appl. No.: 400,712

[22] Filed: Jul. 22, 1982

[30] Foreign Application Priority Data

Sep. 16, 1981 [IL] Israel ..... 63857

[51] Int. Cl.[3] ..... D05B 21/00

[52] U.S. Cl. ..... 112/121.12

[58] Field of Search ..... 112/121.12, 121.15, 112/121.11, 114, 70, 76, 309, 308

[56] References Cited

U.S. PATENT DOCUMENTS 3,037,472 6/1962 Lockwood ..... 112/121.12 X
3,172,379 3/1965 Light ..... 112/121.12
3,769,924 11/1973 Rogers et al. ..... 112/121.12 X
3,988,993 11/1976 Brophy ..... 112/121.12
4,006,698 2/1977 Scholl et al. ..... 112/121.11

FOREIGN PATENT DOCUMENTS 290844 6/1965 Netherlands ..... 112/121.15

*Primary Examiner*—H. Hampton Hunter
*Attorney, Agent, or Firm*—Benjamin J. Barish

[57] ABSTRACT

A sewing machine comprises a clamp securing device carried by the sewing machine carriage and releasably attachable to the workpiece clamp at any one of a plurality of locations so as to selectively locate the clamp with respect to the carriage, and a clamp holding device selectively actuatable to immobilize the clamp with respect to the main frame of the sewing machine when the securing device has been detached from the clamp and until the securing device is reattached at another location on the clamp.

8 Claims, 4 Drawing Figures

FIG. 2
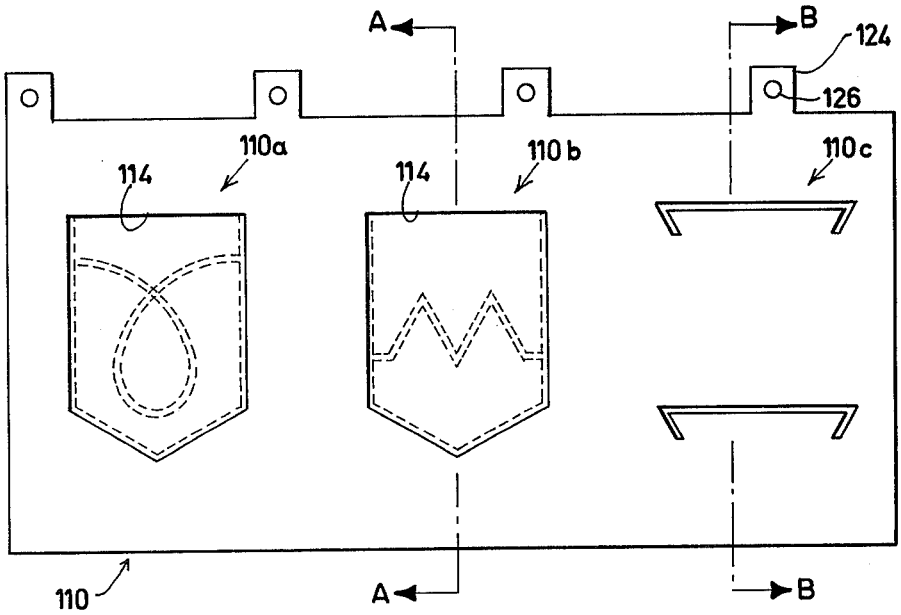
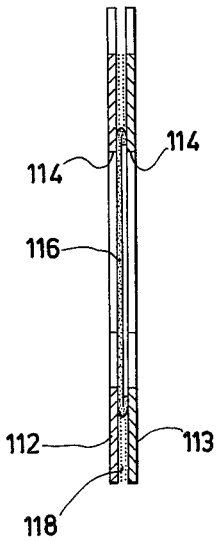
FIG. 2a
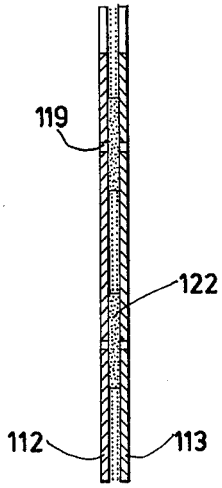
FIG. 2b

SEWING MACHINE INCLUDING WORKPIECE CLAMPING DEVICE

BACKGROUND OF THE INVENTION

The present invention relates to sewing machines, and particularly to sewing machines including workpiece clamping devices. The invention is especially useful in an automatic sewing machine for automatic sewing of fabric, leather, or the like, and is therefore described below with respect to such an application.

Automatic sewing machines commonly include a machine main frame, a sewing machine head mounted thereon, a carriage movable over the machine main frame, and a workpiece clamp carried by the carriage and movable relative to the sewing machine head to locate the workpiece with respect thereto. Generally in such sewing machines, the workpiece clamp provides only a very limited sewing area presentable to the sewing machine head. This limits the number of operations that can be performed on a workpiece, or the number of workpieces that can be processed during a single series of sewing machine operations, thereby requiring the automatic operation of the sewing machine to be frequently interrupted in order to apply a new clamp or to relocate the workpiece with respect to the clamp.

SUMMARY OF THE INVENTION

An object of the present invention is to provide a sewing machine, and particularly a workpiece clamping device, having advantages in the above respects.

According to one broad aspect of the present invention, there is provided a sewing machine including a main frame, a sewing machine head mounted thereon, a carriage movable over the main frame, and a workpiece clamp carried by the carriage and movable relative to the sewing machine head to locate the workpiece with respect thereto; characterized in that the machine further includes a clamp securing device carried by the carriage and releasably attachable to the workpiece clamp at any one of a plurality of locations on the clamp so as to selectively locate the clamp with respect to the carriage, and thereby the workpiece carried by the carriage with respect to the sewing machine head; and a clamp holding device selectively actuable to immobilize the clamp with respect to the main frame when the securing device has been detached from the clamp and until the securing device is reattached at another location on the clamp.

According to another aspect of the invention, there is provided a clamping device for a sewing machine including a main frame, a sewing machine head mounted thereon, and a carriage movable over the main frame, the clamping device comprising a mounting member adapted to be mounted to carriage, a pair of arms pivotably mounted to the mounting member, and a workpiece clamp including a plurality of attaching pins equally spaced along one axis of movement of the carriage with respect to the machine main frame, the pair of arms of the mounting member being actuable to a locking position engaging a selected pair of the attaching pins to secure the clamp at a selected location thereof to the carriage, or to a release position disengaging the attaching pins to permit the pivotable arms to engage another pair of the attaching pins and thereby to secure the clamp to the carriage at another selected location thereof.

It will be seen that a sewing machine including the above clamping device enables sewing operations to be performed within a virtually infinite sewing area along one axis, namely, along the axis of the attaching pins on the workpiece clamp. The provision of such an infinite sewing area is particularly important in automatic sewing machines, since it permits longer sewing sequences to be programmed and automatically performed, thereby substantially decreasing the programming time and substantially increasing the output of such automatic machines.

Further features and advantages of the invention will be apparent from the description below.

BRIEF DESCRIPTION OF THE DRAWINGS

In order to better understand the present invention, it is described below, for purposes of example only, with respect to a preferred embodiment illustrated in the accompanying drawings, wherein:

FIG. 2 is a top plan view illustrating a typical workpiece clamp that may be used in the sewing machine of FIG. 1;

FIG. 2*a* is a sectional view along lines A—A of FIG. 2; and

FIG. 2*b* is a sectional view along lines B—B of FIG. 2.

DESCRIPTION OF A PREFERRED EMBODIMENT

Figure 1:
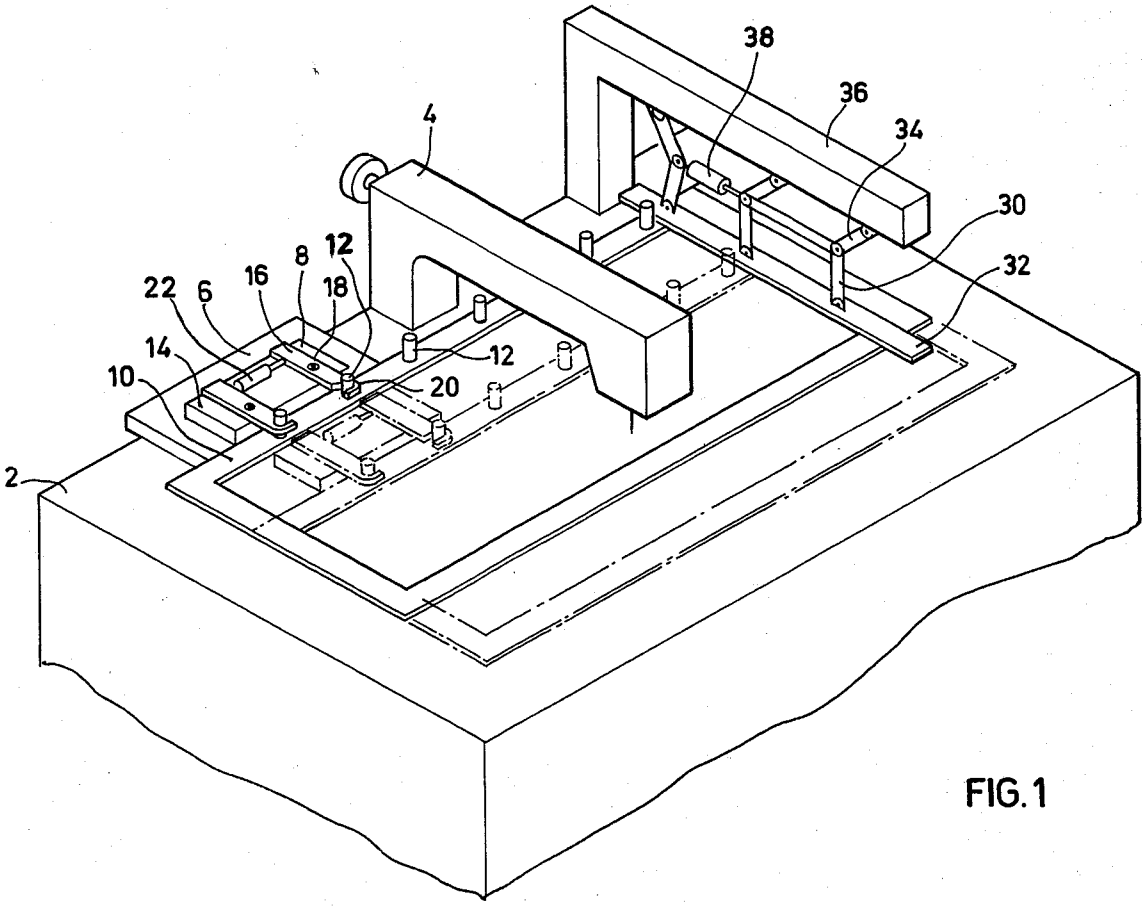
FIG. 1 is a three-dimensional view illustrating one form of sewing machine constructed in accordance with the present invention.

The sewing machine illustrated in FIG. 1 of the drawings comprises a machine main frame, generally designated 2, on which is mounted a sewing machine head 4. Also mounted on the machine main frame 2 is a carriage 6 which is adapted to be driven along both the X-axis and the Y-axis relative to the sewing machine head 4. Carriage 6 carries a clamp securing device, generally designated 8, which device is releasably attachable to a workpiece clamp 10 for moving the latter clamp, including the workpiece carried thereby, along both coordinate axes relative to the sewing machine head 4. Thus, the head 4 is fixed, and during the operation of the machine the workpiece clamp 10 is moved with respect to the head according to the sewing machine operations to be performed on the workpiece carried by the clamp.

The workpiece clamp 10 is provided with a plurality of members for attaching it to the clamp securing device 8. These attaching members are in the form of vertically-extending pins 12 equally spaced along one axis of movement, namely the X-axis, of the carriage 6 relative to the machine main frame 2.

The clamp securing device 8 includes a mounting member 14 for mounting it to carriage 6, and a pair of arms 16 pivotably mounted to the mounting member 14 each about pivot point 18. On one side of pivot point 18, each arm is formed with a hooked end 20 for engagement with the attaching pins 12 of the clamping device 10, and at the other side of the pivot point 18, each arm is connected to an actuator 22. Actuator 22 may be operated manually, pneumatically, electro-mechanically, or by another method, to pivot arms 16 either to a locking position engaging a pair of adjacent pins 12, as shown in FIG. 1, or to an unlocking position released from these pins. Thus, by selectively actuating the pivotable arms 16 of the clamp securing device 8, the latter may be attached to any selected pair of adjacent clamp pins 12 so as to locate the clamp 10 at a selected position with respect to the carriage 6, and thereby to locate the workpiece (not shown) carried by the clamp 10 at a selected position with respect to the sewing machine head 4.

When the clamp securing device 8 is released from one pair of clamping pins 12 for engagement with another pair, the clamp 10 is immobilized with respect to the machine main frame 2 by a clamp holding device, generally designated 30 in FIG. 1. This clamp holding device includes a hold-down bar 32 mounted by means of a plurality of toggle links 34 to an extension 36 of the machine main frame so as to overlie the clamp 10. The toggle links 34 are actuated by an actuator, generally designated 38, which may be operated manually, pneumatically, electromechanically, or by another method as in the case of actuator 22 of the clamp securing device 8. Actuator 38 moves the hold-down bar 32 either to a locking position immobilizing the clamp 10 by pressing it against the machine main frame 2, or to a released position to permit the clamp 10 to move with the carriage 6 after the clamp has been attached by the clamp securing device 8 to the carriage.

Following is one example of a sequence of operations which may be performed, all automatically, by the sewing machine illustrated in FIG. 1: It will be first assumed that the holding device 30 is in its locking position to immobilize the clamp 10, and that the clamp securing device 8 is in its released position to release the clamp 10. As will be recalled from the above description, the holding device 30 is in its locking position when its actuator 38 has been actuated to press down bar 32 against the clamping device 10; and the clamp securing device 8 is in its released condition when its actuator 22 has been actuated to spread apart arms 16 so as to cause their hooked ends 20 to be released from pins 12 of the clamp 10.

In this condition of the apparatus, carriage 6 may be moved to a desired location along the X-axis in order to align its arms 20 with a selected pair of the clamp pins 12, according to the area of the clamp desired to be located with respect to the sewing machine head 4. At this position, actuator 22 of the clamp securing device 8 is actuated to pivot the arms 16 into engagement with the selected pair of pins 12. As soon as the clamp securing device 8 has been actuated, the clamp holding device 30 is actuated to cause its hold-down bar to release the clamp from the machine main frame 2.

The machine may now be operated, e.g. according to a programmed sequence of sewing instructions, to perform machine-programmed sewing operations along both the X-axis and Y-axis within the available sewing area on the workpiece held by the clamp 10. For example, the available sewing area may be 10 inches by 14 inches during this position of the clamp.

After the specified sewing operations have been performed in the available sewing area, a new sewing area may be made available relative to the sewing machine head 4 by: releasing the clamp securing device 8; actuating the clamp holding device 30 to immobilize the clamp; repositioning the clamp securing device 8 to a new location with respect to the clamp 10; actuating the securing device 8 to cause its arms 16 to engage a new pair of the clamp pins 12 at the desired new location of the clamp; and then releasing the clamp holding device 30. The latter operation enables the carriage 6 to move the clamp, and thereby the workpiece, along both the X-axis and Y-axis to perform a new series of sewing operations in the newly-presented sewing area of the workpiece.

It will be appreciated that this sequence can be repeated in both directions along the X-axis as many times as desired and automatically under machine control as programmed into the sewing sequence, thereby enabling the automatic sewing of a substantially increased sewing area without interrupting the sewing sequence.

FIG. 2, and its sectional views FIGS. 2*a* and 2*b*, illustrate one form of workpiece clamp, therein designated 110, which may be used for the clamp 10 in FIG. 1. The clamp 110 illustrated in FIG. 2 includes three separate workpiece sections, namely: (a) section 110*a* for sewing jean pockets according to one form of decorative stitching as shown in broken lines in FIG. 2; (b) a second section 110*b* also for sewing jean pockets but according to a second form of decorative stitching, as also shown in broken lines in FIG. 2; and (c) a third section 110*c* for sewing collars.

As shown particularly in FIGS. 2*a* and 2*b*, the workpiece clamp 110 includes two frame or clamping members 112, 113 adapted to receive the workpiece between them and to engage the workpiece around its periphery. In the pocket-sewing sections 110*a* and 110*b* of the clamp, the two clamping members 112, 113 are formed with aligned cut-outs 114, as shown in FIG. 2*a*, exposing the workpiece, therein designated 116, which is of a material adapted to be sewn to define a jeans pocket. Preferably, the inner confronting faces of the two frame members 112, 113 are lined with sandpaper, as shown at 118, to securely hold the workpiece between them during the sewing operation.

The cut-outs 119 in the two clamping members 112, 113 in the collar-sewing section 110*c* of the clamp 110 are of slit-shape, as illustrated in FIG. 2, substantially configured according to the sewing line for sewing the collars. As shown in FIGS. 2 and 2*b*, there are two cut-outs 119 in the collar-sewing section 110*c* of the clamp 110 in vertical alignment with each other. The two clamping members 112, 113 in this section of the clamp are also preferably lined on their inner confronting faces with sandpaper, as shown at 120 in FIG. 2*b*, in order to firmly secure the workpiece 122 between them during the sewing operation.

Both of the clamping members 112, 113 are provided with lugs 124 along one edge, which lugs are formed with openings 126 to receive the attaching pins (not shown in FIG. 2) corresponding to attaching pins 12 in FIG. 1.

It will thus be seen that the invention provides an arrangement which enables the sewing area of a sewing machine to be substantially increased, thereby permitting automatic sewing in an increased sewing area to be programmed into a sewing sequence. The invention not only substantially increases the sewing area for the sewing operations to be performed in a programmed sequence, but also provides space for additional workpiece clamps, which clamps may take a wide variety of forms, both for single-layer sewing, and also for multy-layer sewing.

While the invention has been described with respect to one preferred embodiment, it will be appreciated that many variations, modifications and other applications of the invention may be made.

What is claimed is:

1. A sewing machine including a main frame, a sewing machine head mounted thereon, a carriage movable over said main frame, and a workpiece clamp carried by said carriage and movable relative to said sewing machine head to locate the workpiece with respect thereto; characterized in that said machine further includes:

a clamp securing device carried by said carriage and releasably attachable to said workpiece clamp to any one of a plurality of locations on said clamp so as to selectively locate said clamp with respect to said carriage, and thereby the workpiece carried by the carriage with respect to said sewing machine head;

and a clamp holding device selectively actuable to immobilize said clamp with respect to said main frame when said securing device has been detached from said clamp and until the securing device is reattached at another location on said clamp.

2. A sewing machine according to claim 1, wherein said clamp includes a plurality of attaching members spaced along one axis of movement of the carriage with respect to the machine main frame.

3. A sewing machine according to claim 2, wherein said plurality of attaching members are pins equally spaced along one axis of movement of the carriage with respect to the machine main frame, said clamp securing device including a pair of arms actuable to a locking position engaging a pair of said attaching pins to secure said clamp, at a selected position thereof, to said carriage, or to a release position disengaging said attaching pins to permit the securing device to engage another pair of said attaching pins, and thereby to secure said clamp at another selected location thereof.

4. A sewing machine according to claim 3, wherein said pair of arms of said clamp securing device are pivotably mounted to a mounting member and include hooks at one end for engaging and disengaging a selected pair of said attaching pins.

5. A sewing machine according to claim 1, wherein said holding device comprises a hold-down member overlying said clamp and actuable either to a locking position to press said clamp against the machine main frame while the clamp securing device is moved to a new position with respect to the clamp, or to a release position to permit the clamp to move with the carriage with respect to the machine main frame.

6. A sewing machine according to claim 1, wherein said clamp includes at least two clamping members adapted to receive the workpiece therebetween and to engage the workpiece around the periphery thereof.

7. A sewing machine according to claim 6, wherein the inner confronting faces of said clamping members are lined with sandpaper for firmly gripping the workpiece therebetween.

8. A clamping device for a sewing machine including a main frame, a sewing machine head mounted thereon and a carriage movable over said main frame, said clamping device comprising a mounting member adapted to be mounted to said carriage, a pair of arms pivotably mounted to said mounting member, and a workpiece clamp including a plurality of attaching pins equally spaced along one axis of movement of the carriage with respect to the machine main frame, said pair of arms of the mounting member being actuable to a locking position engaging a selected pair of said attaching pins to secure said clamp at a selected location thereof to said carriage, or to a release position disengaging said attaching pins to permit the pivotable arms to engage another pair of said attaching pins and thereby to secure said clamp to said carriage at another selected location thereof.

* * * * *